US010422570B2

(12) United States Patent
Xia et al.

(10) Patent No.: US 10,422,570 B2
(45) Date of Patent: Sep. 24, 2019

(54) GUIDE ASSEMBLY FOR USE IN DOOR OF REFRIGERATOR, AND REFRIGERATOR

(71) Applicant: QINGDAO HAIER JOINT STOCK CO., LTD., Qingdao, Shandong Provice (CN)

(72) Inventors: Enpin Xia, Qingdao (CN); Hao Zhang, Qingdao (CN); Xiaobing Zhu, Qingdao (CN)

(73) Assignee: QINGDAO HAIER JOINT STOCK CO., LTD., Qingdao, Shandong Province (CN)

( * ) Notice: Subject to any disclaimer, the term of this patent is extended or adjusted under 35 U.S.C. 154(b) by 0 days.

(21) Appl. No.: 16/065,816

(22) PCT Filed: Jun. 17, 2016

(86) PCT No.: PCT/CN2016/086173
§ 371 (c)(1),
(2) Date: Jun. 25, 2018

(87) PCT Pub. No.: WO2017/113637
PCT Pub. Date: Jul. 6, 2017

(65) Prior Publication Data

US 2019/0011173 A1 Jan. 10, 2019

(30) Foreign Application Priority Data

Dec. 29, 2015 (CN) ..... 2015 1 1023343

(51) Int. Cl.
*F25D 23/02* (2006.01)
*E05D 15/10* (2006.01)
(Continued)

(52) U.S. Cl.
CPC ..... *F25D 23/021* (2013.01); *E05D 15/0604* (2013.01); *E05D 15/10* (2013.01);
(Continued)

(58) Field of Classification Search
CPC ..... F25D 23/021; F25D 2323/02; E05D 15/0604; E05D 15/0608; E05D 15/0613;
(Continued)

(56) References Cited

U.S. PATENT DOCUMENTS 8,763,205 B2 * 7/2014 Schmidhauser ..... E05D 15/10 16/92
2005/0005524 A1 1/2005 Berry et al.
(Continued)

FOREIGN PATENT DOCUMENTS

| | | | | | |
|---|---|---|---|---|---|
| CN | 2310295 | Y | | 3/1999 | |
| CN | 102383684 | A | * | 3/2012 | ..... E05D 15/10 |
| CN | 102425904 | A | | 4/2012 | |
| CN | 104048469 | A | | 9/2014 | |
| CN | 104114064 | A | | 10/2014 | |
| CN | 205037670 | U | | 2/2016 | |
| CN | 105466124 | A | | 4/2016 | |
| EP | 2631575 | A2 | * | 8/2013 | ..... F25D 23/021 |
| EP | 2799651 | A1 | * | 11/2014 | ..... E05D 15/10 |
| EP | 2837763 | A1 | * | 2/2015 | ..... E05D 15/1042 |

(Continued)

*Primary Examiner* — Andrew M Roersma
(74) *Attorney, Agent, or Firm* — Cheng-Ju Chiang

(57) ABSTRACT

A guide assembly for use in a door of a refrigerator comprises: a sliding rail; a movable member located above the sliding rail; and a connection member connected and fixed to the door. The sliding rail comprises a slide and a track both extending in the left and right direction. The movable member can move along the slide in a reciprocating motion in the left and right direction. The movable member also has a sliding groove extending in the frontward and rearward direction. The connection member comprises a first roller disposed at the sliding groove and capable of moving along the sliding groove in the frontward and rearward direction. The guide assembly further comprises a guide structure disposed under the connection member. The guide structure is movably disposed in the track to guide the movement of the door.

18 Claims, 4 Drawing Sheets

(51) Int. Cl.
*E05D 15/56* (2006.01)
*E05D 15/06* (2006.01)

(52) U.S. Cl.
CPC ..... *E05D 15/56* (2013.01); *F25D 23/02* (2013.01); *F25D 23/028* (2013.01); *E05D 2015/1031* (2013.01); *E05D 2015/1039* (2013.01); *E05Y 2900/31* (2013.01); *F25D 2323/02* (2013.01); *F25D 2323/021* (2013.01)

(58) Field of Classification Search
CPC . E05D 15/0621; E05D 15/0626; E05D 15/10; E05D 15/1042; E05D 2015/1026; E05D 2015/1055; E05Y 2900/31
See application file for complete search history.

(56) References Cited

U.S. PATENT DOCUMENTS

2015/0123533 A1* 5/2015 Rivas ..... F25D 23/021 312/405
2018/0187949 A1* 7/2018 Wu ..... E05D 15/0621

FOREIGN PATENT DOCUMENTS

| | | | | | |
|---|---|---|---|---|---|
| EP | 3088647 | A1 | * | 11/2016 | ..... E05D 15/10 |
| JP | 4338693 | B2 | | 10/2009 | |
| JP | 2010101057 | A | * | 5/2010 | ..... E05D 15/1042 |
| JP | 4487133 | B2 | | 6/2010 | |
| JP | 2012202206 | A | * | 10/2012 | ..... E05D 15/10 |
| KR | 101475940 | B1 | * | 1/2015 | ..... E05D 15/1042 |

* cited by examiner

GUIDE ASSEMBLY FOR USE IN DOOR OF REFRIGERATOR, AND REFRIGERATOR

CROSS REFERENCE TO RELATED APPLICATIONS

The present application is a 35 U.S.C. § 371 National Phase conversion of International (PCT) Patent Application No. PCT/CN2016/086173, filed on Jun. 17, 2016, which further claims benefit of Chinese Patent Application No. 201511023343.0, filed on Dec. 29, 2015, the disclosure of which is incorporated by reference herein. The PCT International Patent Application was filed and published in Chinese.

TECHNICAL FIELD

The present disclosure relates to the field of refrigerator manufacturing, and in particular, to a refrigerator and a guide assembly for use in door of the refrigerator.

BACKGROUND

With the gradual improvement of living standards, the market now pays more attention to side-by-side refrigerators with larger storage spaces. On the other hand, users have higher demands for the use experience of refrigerators. A door opening way of the existing side-by-side refrigerator is similar to that of the traditional refrigerator in that a door is opened by rotating around a preset rotating shaft. However, when the door is opened in this way, a larger space in front of the refrigerator will be occupied. In view of this, a refrigerator adopting a push-pull type door has been proposed in the industry. For example, Chinese Patent Application No. 97221633.2 discloses a push-pull type dual-door refrigerator which is capable of saving an indoor space and in which a pulley slides directly in a guide rail. The sliding process is not stable, and the impact force suffered by the pulley during turning is relatively large, thereby affecting the service life of the pulley.

Therefore, it is necessary to provide a novel refrigerator and a novel guide assembly for use in a door of the refrigerator.

SUMMARY

An objective of the present disclosure is to provide a refrigerator and a guide assembly for use in a door of the refrigerator. According to the refrigerator and the guide assembly of the present disclosure, the door can be opened by sliding in a left-right direction, such that the structure is stable, the space requirement of the refrigerator can be reduced, and therefore, the user experience can be improved.

To fulfill said objective of the present disclosure, the present disclosure provides a guide assembly for use in door of a refrigerator. The guide assembly comprises a sliding rail, a movable member located above the sliding rail, and a connection member fixedly connected to the door. The sliding rail comprises slides extending in a left-right direction, and a track. The movable member may move leftwards and rightwards along the slides in a reciprocating manner. The movable member is also provided with a sliding groove extending in a front-back direction. The connection member comprises a first roller arranged in the sliding groove and capable of moving frontwards and backwards along the sliding groove. The guide assembly further comprises a guide structure arranged below the connection member. The guide structure is movably arranged in the track to guide the movement of the door.

As an improvement of the present invention, the sliding rail comprises two front and rear slides which extend in a left-right direction and are parallel to each other, the track being arranged between the two slides.

As a further improvement of the present invention, the movable member comprises two groups of front and rear second rollers which are respectively pressed against the two slides.

As a further improvement of the present invention, an auxiliary roller is further arranged below the movable member, and an auxiliary slide which is parallel to the slides is formed on the sliding rail.

As a further improvement of the present invention, the auxiliary slide is arranged in front of the track.

As a further improvement of the present invention, the track comprises a first track arranged parallel to the slides, a second track extending in the front-back direction, and an arc-shaped track communicating the first track with the second track.

As a further improvement of the present invention, the connection member comprises a first connection plate and a second connection plate which are fixed on the door and arranged on the left and right respectively, and four groups of the first rollers which face each other on the left and right are arranged below the first connection plate and the second connection plate respectively.

As a further improvement of the present invention, a horizontal support plate for connecting the first connection plate and the second connection plate is arranged below one side, which faces the second connection plate, of the first connection plate, and the guide structure comprises a guide column arranged vertically below the horizontal support plate.

As a further improvement of the present invention, a positioning pin for guiding the door to be closed accurately is also arranged on the rear side of the connection member, and is fixedly arranged on the horizontal support plate.

The present invention further provides a refrigerator comprising a door and a cabinet, wherein the door includes a first door body and a second door body which are arranged in front of the cabinet side by side, and the guide assembly is also arranged between the first door body and/or the second door body and the cabinet.

The present disclosure has the following beneficial effects: by the adoption of the refrigerator and the guide assembly for use in the door of the refrigerator, the first rollers and the sliding groove cooperate to complete the forward and backward movements of the door. Then, the guide structure and the track cooperate to complete the change in the movement direction of the door. Furthermore, the door moves leftwards and rightwards along the slides through the movable member, thereby completing opening and closing of the door by leftward and rightward sliding. The guide assembly has a stable structure, and can effectively reduce the space requirement for the refrigerator to improve the user experience.

DETAILED DESCRIPTION

Figure 1:
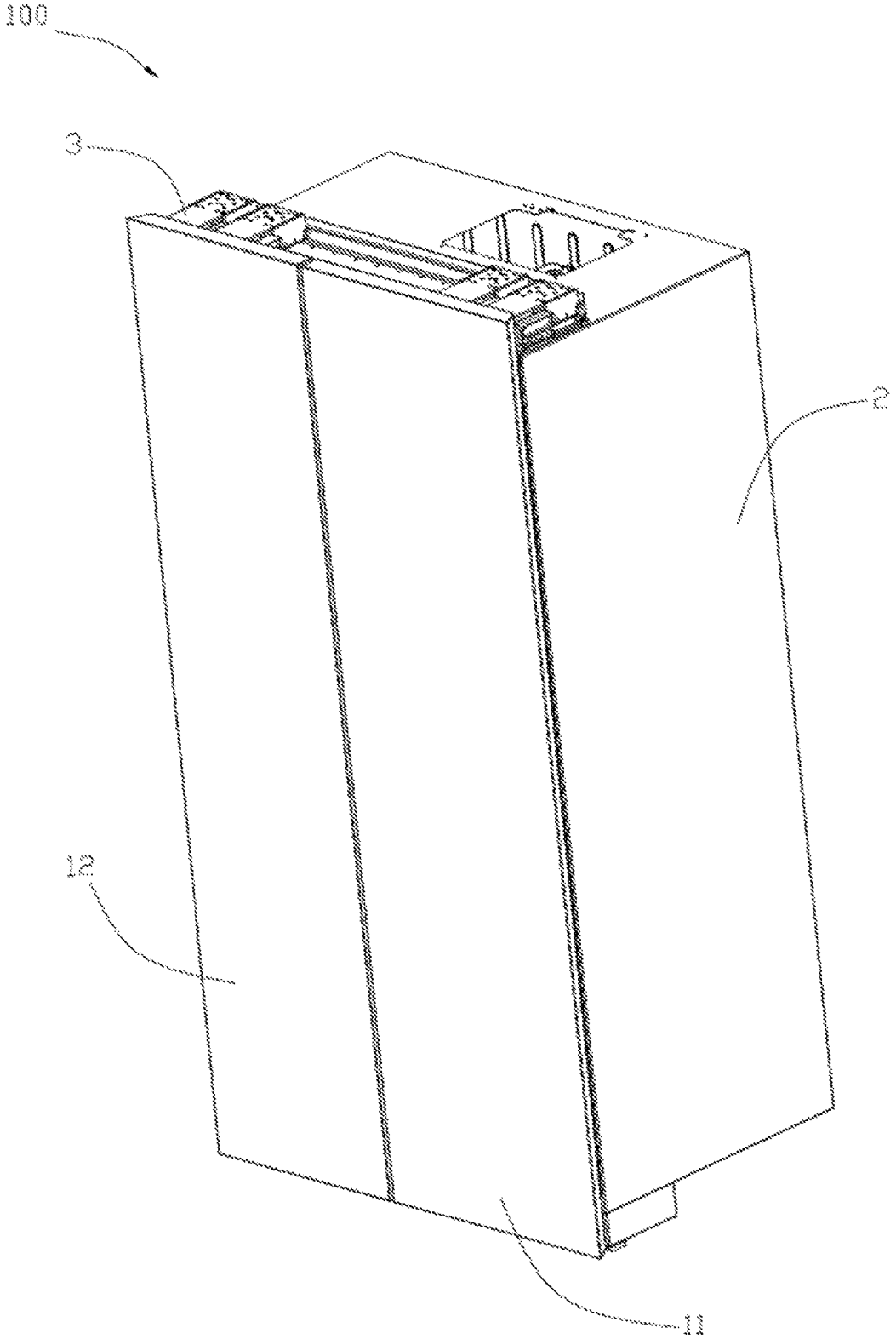
FIG. 1 is a schematic structural diagram when the door of the refrigerator of the present disclosure are closed.

The present disclosure will be described below in detail with reference to the embodiments shown in the drawings. However, these embodiments do not limit the present disclosure. Modifications to the structure, method or function based on these embodiments made by those skilled in the art are all also included in the protection scope of the present disclosure.

FIGS. 1 to 7 illustrate a preferred embodiment of the present disclosure. FIG. 1 illustrates a schematic structural diagram of a side-by-side refrigerator 100 of the present disclosure. The refrigerator 100 comprises a door and a cabinet 2. The door includes a first door body 11 and a second door body 12 in front of the cabinet 2 side by side. A guide assembly 3 for the door bodies of the refrigerator is further arranged between the first door body 11 and/or the second door body 12 and the cabinet 2.

Referring to FIGS. 4 to 7, the guide assembly 3 for use in the door of the refrigerator provided by the present disclosure comprises a sliding rail 31, a movable member 32 located above the sliding rail 31, and a connection member 33 fixedly arranged on the door. The sliding rail 31 comprises two front and rear slides 311 which extend in a left-right direction and are parallel to each other, and a track 312, the track 312 being arranged between the two slides 311. The track 312 comprises a first track 3121 arranged parallel to the slides 311, a second track 3122 extending in the front-back direction, and an arc-shaped track 3123 communicating the first track 3121 with the second track 3122. An auxiliary slide 313 which extends parallel to the slides is also arranged in front of the track 312.

The movable member 32 comprises a first main body portion 321 and a second main body portion 322 which are arranged on the left and right side by side respectively, and a fixing plate 323 which is arranged below the first main body portion 321 and the second main body portion 322 and used for fixedly connecting the first main body portion 321 with the second main body portion 322. Second roller 324 pressed against the two slides 311 are respectively arranged on the front side and the rear side of each of the first main body portion 321 and the second main body portion 322, respectively. The second rollers 324 are divided into two front and rear groups which are arranged to roll leftwards and rightwards along the slides 311 in a reciprocating manner. The fixing plate 323 is strip-shaped, and the left end and the right end of the fixing plate 323 are respectively provided with auxiliary rollers 325. The auxiliary rollers 325 are movably arranged in the auxiliary slides 313 respectively and capable of rolling leftwards and rightwards along the auxiliary slides 313 respectively.

The left side and the right side of each of the first main body portion 321 and the second main body portion 322 are horizontally recessed to form sliding grooves 326 extending in a front-back direction. In addition, the top of each of the first main body portion 321 and the second main body portion 322 is also recessed downwards to form an auxiliary sliding groove 327 extending in the front-back direction.

The connection member 33 comprises a first connection plate 331 and a second connection plate 332 which are fixed on the door and arranged on the left and right respectively. Four groups of the first rollers 333 which face each other on the left and right are arranged below the first connection plate 331 and the second connection plate 332, respectively. The first rollers 333 are arranged in the sliding groove 326 and may move forwards and backwards along the sliding groove 326. The connection member 33 further comprises a horizontal support plate 334 for connecting the first connection plate 331 with the second connection plate 332, and fixing members 335 for fixedly connecting the first rollers 333 to the lower side of the first connection plate 331 or the second connection plate 332. The horizontal support plate 334 is fixed to the two fixing members 335 corresponding to one side, which faces the second connection plate, of the first connection plate.

Limiting rollers 336 are also fixedly arranged below the first connection plate 331 and the second connection plate 332. The limiting rollers 336 are movably arranged in the auxiliary sliding groove 327 and are capable of rolling forwards and backwards along the auxiliary sliding groove 327. When the connection member 33 moves forwards and backwards with respect to the movable member 32, through the cooperation of the limiting rollers 336 and the auxiliary sliding groove 327, the interference friction between the fixing member 335 and the first main body portion 321 and between the fixing member 335 and the second main body portion 322 can be avoided, thereby ensuring that the guide assembly 3 operates smoothly.

The guide assembly 3 further comprises a guide structure arranged below the connection member 33. In the present embodiment, the guide structure comprises a guide column 337 which is arranged vertically below the horizontal support plate 334. The guide column 337 may be movably arranged in the track 31 to guide the movement of the door. In other embodiments of the present disclosure, the guide structure comprises a guide wheel arranged below the horizontal support plate 334. When the door is opened or closed, the movement direction of the door may be smoothly changed by the cooperation of the guide column 337 or the guide wheel and the arc-shaped track 3123.

Figure 2:
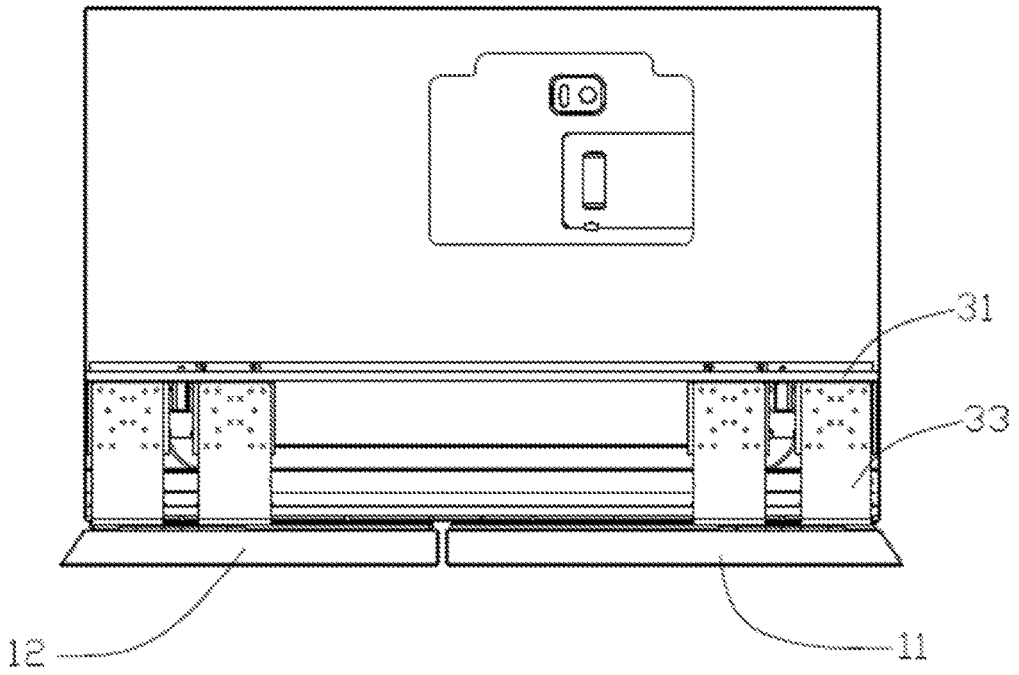
FIG. 2 is a top view of the refrigerator in FIG. 1.
Figure 3:
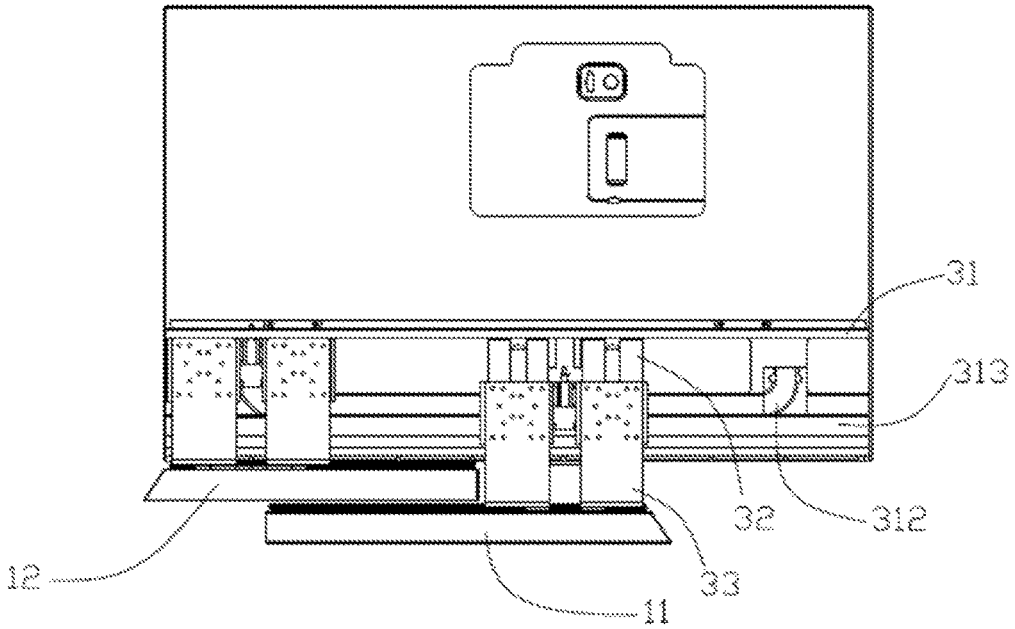
FIG. 3 is a schematic state diagram in the opening process of the first door body of the refrigerator in FIG. 2.
Figure 4:
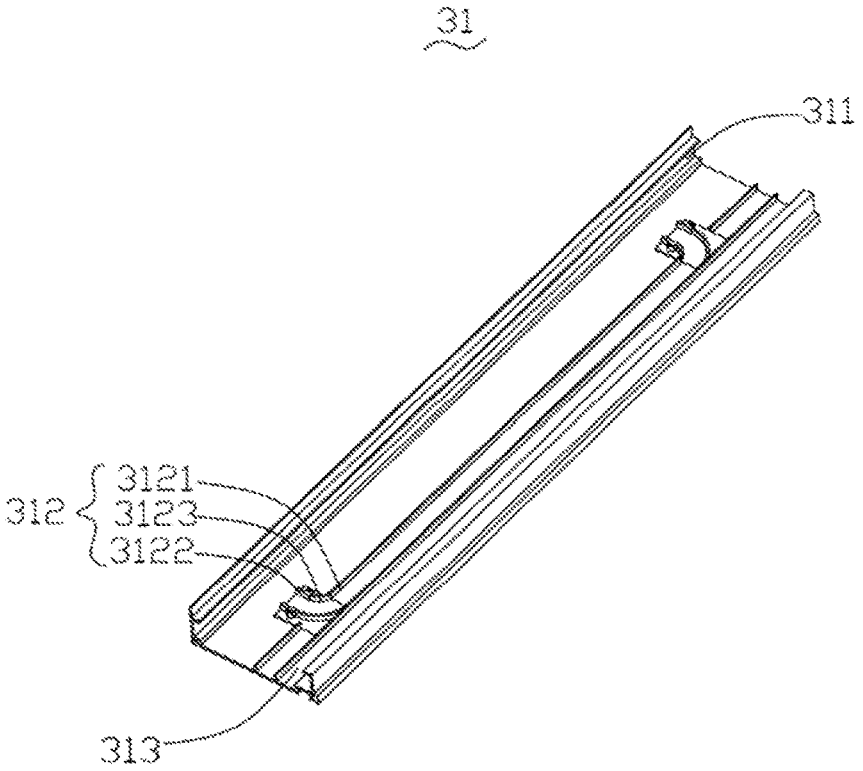
FIG. 4 is a schematic structural diagram of the sliding rail for the guide assembly of the door of the refrigerator of the present disclosure.
Figure 5:
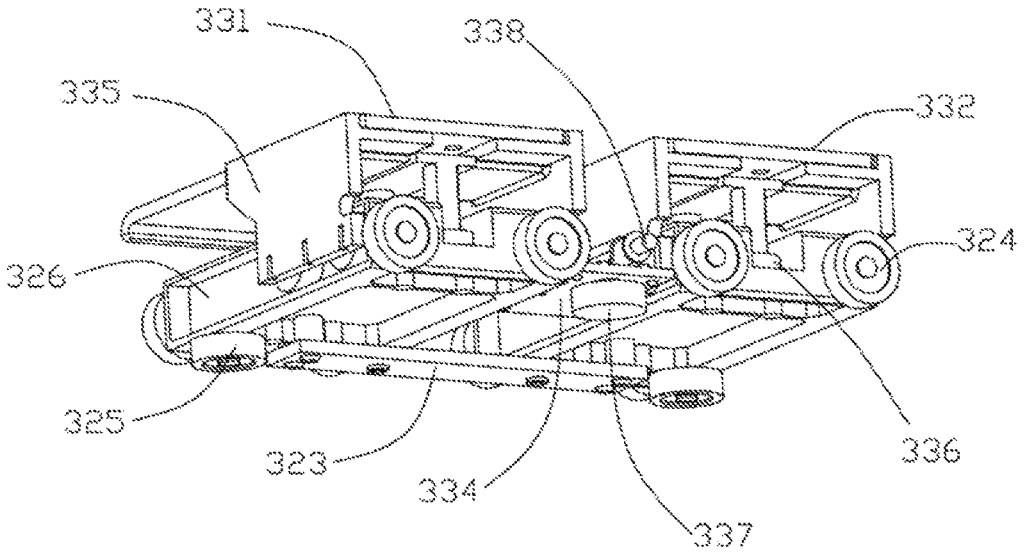
FIG. 5 is a schematic combination diagram of the movable member and the connection member of the guide assembly of the door of the refrigerator of the present disclosure.
Figure 6:
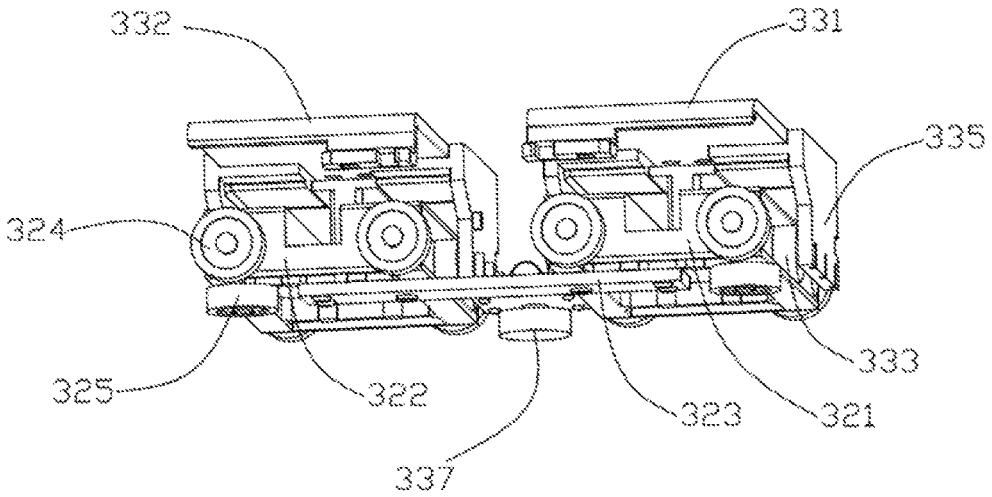
FIG. 6 is a schematic diagram of the movable member and the connection member of the guide assembly of the door of the refrigerator in FIG. 5 from another angle.
Figure 7:
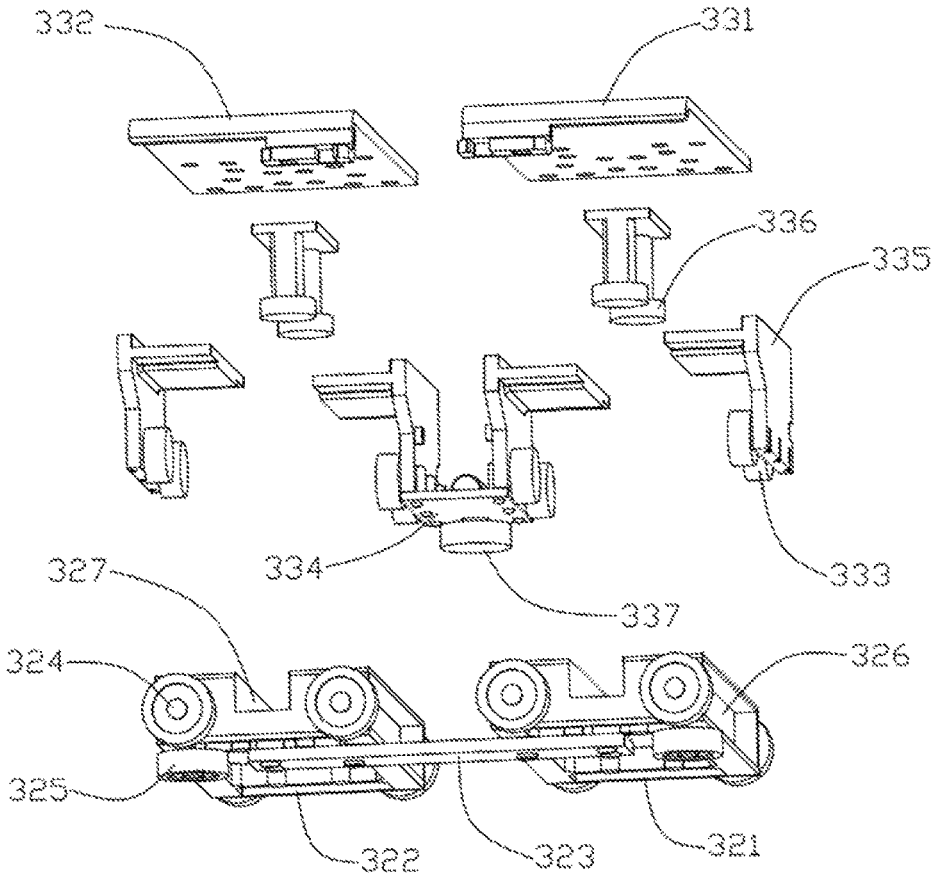
FIG. 7 is an exploded diagram of the movable member and the connection member of the guide assembly of the door of the refrigerator in FIG. 5.

FIGS. 2 and 3 illustrate schematic process diagrams of the first door body 11 of the refrigerator 100 from a closed state to a completely opened state. First, the first rollers 333 roll forwards along the sliding groove 326. The connection member 33 drives the first door body 11 to move forwards. Then, the guide column 337 enters the second track 3122 and the arc-shape track 3123 sequentially. Under the action of the arc-shaped track 3123, the connection member 33 is adjusted from the forward movement to the leftward movement. In the meanwhile, the first rollers 333 stay at the front side of the sliding groove 326. The left side of the first door body 11 covers a portion of the right side of the second door body 12. Then, the connection member 33 and the first door body 11 move leftwards along the slides 311 along with the second rollers 324 of the movable member 32. As such, the process of opening the first door body 11 by sliding leftwards is completed.

A positioning pin 338 for guiding the door to close accurately is also arranged on the rear side of the connection member 33. Specifically, the positioning pin 338 is fixedly arranged in the horizontal support plate 334 in a front-back direction.

In light of above, by the adoption of the refrigerator 100 and the guide assembly 3 for use in the door of the refrigerator, the door slide leftwards and rightwards to be opened or closed, such that the space requirement for the refrigerator 100 is effectively reduced. In addition, the structure is stable, and the user experiment is improved.

It should be understood that although the description is described according to the above embodiments, each embodiment may not only include one independent technical solution. The presentation manner of the description is only for the sake of clarity. Those skilled in the art should take the description as an integral part. The technical solutions of the respective embodiments may be combined properly to form other embodiments understandable by those skilled in the art.

The above detailed description only illustrates the feasible embodiments of the present disclosure, and is not intended to limit the protection scope of the present disclosure. Equivalent embodiments or modifications within the scope and spirit of the present disclosure shall be embraced by the protection scope of the present disclosure.

What is claimed is:

1. A guide assembly for use in a door of a refrigerator, the guide assembly comprising a sliding rail, a movable member located above the sliding rail, a connection member configured for fixedly connecting to the door, and a guide structure, wherein:

the sliding rail comprises slides extending in a left-right direction, and a track;

the movable member may move leftwards and rightwards along the slides in a reciprocating manner and is provided with a sliding groove extending in a front-back direction;

the connection member comprises a first roller arranged in the sliding groove and capable of moving forwards and backwards along the sliding groove;

the guide structure is arranged below the connection member and movably arranged in the track to guide the movement of the door; and wherein the connection member comprises a first connection plate and a second connection plate which are configured for fixing on the door, a horizontal support plate for connecting the first connection plate with the second connection plate, and fixing members for fixedly connecting the first rollers to a lower side of the first connection plate or the second connection plate, the guide structure comprises a guide column or a guide wheel arranged below the horizontal support plate and cooperated with the track.

2. The guide assembly according to claim 1, wherein the sliding rail comprises two front and rear slides which extend in the left-right direction and are parallel to each other, the track being arranged between the two slides.

3. The guide assembly according to claim 2, wherein the movable member comprises two groups of front and rear second rollers which are respectively pressed against the two slides.

4. The guide assembly according to claim 1, wherein an auxiliary roller is further arranged below the movable member, and an auxiliary slide which is parallel with the slides is formed on the sliding rail.

5. The guide assembly according to claim 4, wherein the auxiliary slide is arranged in front of the track.

6. The guide assembly according to claim 1, wherein the track comprises a first track arranged parallel to the slides, a second track extending in the front-back direction, and an arc-shaped track communicating the first track with the second track.

7. The guide assembly according to claim 1, wherein the first connection plate and the second connection plate are arranged on the left and right respectively, and four groups of the first rollers which face each other on the left and right are arranged below the first connection plate and the second connection plate respectively.

8. The guide assembly according to claim 1, wherein the horizontal support plate for connecting the first connection plate with the second connection plate is arranged below one side, which faces the second connection plate, of the first connection plate, and the guide structure comprises the guide column arranged vertically below the horizontal support plate.

9. The guide assembly according to claim 1, wherein a positioning pin for guiding the door to be closed accurately is arranged on a rear side of the connection member, and is fixedly arranged on the horizontal support plate.

10. A refrigerator, comprising a door and a cabinet, wherein the door includes a first door body and a second door body which are arranged in front of the cabinet side by side; wherein a guide assembly is arranged between the first door body and/or the second door body and the cabinet, and the guide assembly comprises a sliding rail, a movable member located above the sliding rail, a connection member fixedly connected to the door, and a guide structure; wherein the sliding rail comprises slides extending in a left-right direction, and a track;

the movable member may move leftwards and rightwards along the slides in a reciprocating manner and is provided with a sliding groove extending in a front-back direction;

the connection member comprises a first roller arranged in the sliding groove and capable of moving forwards and backwards along the sliding groove;

the guide structure is arranged below the connection member and movably arranged in the track to guide the movement of the door; and wherein the connection member comprises a first connection plate and a second connection plate which are fixed on the door, a horizontal support plate for connecting the first connection plate with the second connection plate, and fixing members for fixedly connecting the first rollers to a lower side of the first connection plate or the second connection plate, the guide structure comprises a guide column or a guide wheel arranged below the horizontal support plate and cooperated with the track.

11. The refrigerator according to claim 10, wherein the sliding rail comprises two front and rear slides which extend in a left-right direction and are parallel to each other, the track being arranged between the two slides.

12. The refrigerator according to claim 11, wherein the movable member comprises two groups of front and rear second rollers which are respectively pressed against the two slides.

13. The refrigerator according to claim 10, wherein an auxiliary roller is further arranged below the movable member, and an auxiliary slide which is parallel with the slides is formed on the sliding rail.

14. The refrigerator according to claim 13, wherein the auxiliary slide is arranged in front of the track.

15. The refrigerator according to claim 10, wherein the track comprises a first track arranged parallel to the slides, a second track extending in the front-back direction, and an arc-shaped track communicating the first track with the second track.

16. The refrigerator according to claim 10, wherein the first connection plate and the second connection plate are arranged on the left and right respectively, and four groups of the first rollers which face each other on the left and right are arranged below the first connection plate and the second connection plate respectively.

17. The refrigerator according to claim 10, wherein the horizontal support plate for connecting the first connection plate with the second connection plate is arranged below one side, which faces the second connection plate, of the first connection plate, and the guide structure comprises the guide column arranged vertically below the horizontal support plate.

18. The refrigerator according to claim 10, wherein a positioning pin for guiding the door to be closed accurately is arranged on a rear side of the connection member, and is fixedly arranged on the horizontal support plate.

* * * * *